United States Patent [19]

Glasmeyer et al.

[11] Patent Number: 4,544,405

[45] Date of Patent: Oct. 1, 1985

[54] METHOD OF PRODUCING STEELS OF GREAT PURITY AND LOW GAS CONTENT IN STEEL MILLS AND STEEL FOUNDRIES AND APPARATUS THEREFOR

[75] Inventors: Ulrich Glasmeyer, Freudenberg; Horst Willaschek, Oberhausen, both of Fed. Rep. of Germany

[73] Assignee: M.A.N. Maschinenfabrik Augsburg-Nurnberg Aktiengesellschaft, Fed. Rep. of Germany

[21] Appl. No.: 647,024

[22] Filed: Sep. 4, 1984

[30] Foreign Application Priority Data

Sep. 2, 1983 [DE] Fed. Rep. of Germany ..... 3331710
Dec. 31, 1983 [DE] Fed. Rep. of Germany ..... 3346718

[51] Int. Cl.[4] ..... C21C 7/00
[52] U.S. Cl. ..... 75/51.2; 75/51.6
[58] Field of Search ..... 75/51–56, 75/59, 60

[56] References Cited

U.S. PATENT DOCUMENTS

| | | | |
|---|---|---|---|
| 16,082 | 11/1856 | Bessemer | 75/60 |
| 3,575,695 | 4/1971 | Miyashita | 75/51 |
| 3,598,383 | 8/1971 | Moore | 75/51 |
| 3,820,767 | 6/1974 | Metz | 75/51 |
| 4,036,635 | 7/1977 | Klapdar | 75/51 |
| 4,309,025 | 1/1982 | Meichsner | 75/58 |

*Primary Examiner*—Peter D. Rosenberg
*Attorney, Agent, or Firm*—McGlew and Tuttle

[57] ABSTRACT

A method for producing steels of high purity and low gas content in steel mills and steel foundries comprises melting the steel with the desired alloying components in a ladle, directing an inert gas and oxygen mixture to the ladle with the molten steel to decarburize the steel in at least one phase, and carrying out decarburization, deoxidation and fining in separate operational steps without disturbing the coherence of the entire process cycle. The apparatus for carrying out the method includes a converter for the decarburization of the steel in several phases permitting successively a treatment with an air inert gas oxygen mixture and pure inert gas in gas amounts greatly varying from each other. In addition, a ladle is required for fine-flushing the steel succeeding the converter. The converter mouth advantageously has a mechanism permitting temporary reduction of the converter opening area. The converter also has a gas volume control and injection holes permitting a variation of the different gases to be injected. Injection holes are advantageously provided with individual controls. A ladle for the finished melt is lined with basic or neutral refractory materials so that the ladle lining can furnish no oxygen to the melt. A tapping ladle for the finished melt is advantageously lined with dolomite.

20 Claims, 2 Drawing Figures

TYPICAL ASM PROCESS CYCLE

METHOD OF PRODUCING STEELS OF GREAT PURITY AND LOW GAS CONTENT IN STEEL MILLS AND STEEL FOUNDRIES AND APPARATUS THEREFOR

FIELD AND BACKGROUND OF THE INVENTION

This invention relates in general to the production of steel and in particular to a new and useful method and apparatus for producing steels of great purity and low gas content for special requirements.

The invention relates to a method and the equipment to produce steels of great purity and low gas content for special requirements, whereby the liquid steel is refined with an inert gas in a ladle and the treatment stages decarburization and deoxidation are carried out in a converter.

Various methods to produce steels of great purity and low gas contents are already known.

Best known are melting in the arc furnace or melting in the arc furnace with subsequent decarburization in a converter, using mixed gases or vacuum.

From the energy aspect, producing steels in the arc furnace only is very costly and problematical as far as the purity to be obtained is concerned. Producing such steels in the arc furnace with subsequent decarburization in presently known converters using mixed gases has the disadvantage that these converters, originally designed for the production of chromium steels, have a smaller specific reaction space than is required for the production of the special steels mentioned. Prerequisite for the required high decarburization and heating rate is a large specific reaction volume with a high specific oxygen supply.

Moreover, due to the air entering the reaction chamber, a reoxidation of the melt cannot be avoided during the deoxidation phase.

Furthermore, an intensive air oxygen contact takes place during the pouring of the reduced steel, resulting in disturbing oxidic contaminations, thus leading to scrap in the product.

From the aspect of equipmental and operating sophistication, producing the mentioned steels with subsequent decarburization in a vacuum converter is more complicated and costly.

The above mentioned processes are also difficult to run and require much experience and skilled personnel.

It is further known that in the production of these steels a final treatment in ladles flushed by inert gas can be carried out. But here, too, setting the desired values as to alloy components, temperature, oxygen, hydrogen and purity precisely is not possible, or only with difficulty, if the specified initial values of the arc furnace or of the presently known convertet cannot be set reproducibly.

It is further of particular disadvantage in the three mentioned methods that the desired metallurgical values cannot be set with sufficient accuracy so that material faults are unavoidable which can no longer be tolerated in highly stressed components of installations, such as in nuclear power plants.

SUMMARY OF THE INVENTION

Accordingly, the invention provides a method and the equipment to produce the above mentioned steel grades which no longer have the disadvantages mentioned above, making it possible in particular to assure a stable, well reproducible steel quality while at the same time increasing productivity, reducing the risk of producing scrap and providing good process control.

The equipment to carry out the method according to the invention should further be of relatively simple design and be operable energy-efficiently, making the use of vacuume and high operating costs unnecessary.

According to the invention, this problem is solved for a method of the kind mentioned at the outset in that, before the ladle treatment and after the desired alloy components are melted, a decarburization in a converter takes place by means of an inert gas/air/oxygen mixture in one or more phases, the heating phase known per se being followed by a quick deoxidizing phase and upon drossing, by a fine flusing phase with inert gas in the ladle.

During the ladle treatment it may be advantageous to add to the melt a collecting slag. This is followed by the fine flushing phase, whereby the development of disturbing, coarse inclusions is avoided in particular.

In this connection, argon in particular may be used as inert gas.

It may be advantageous to reduce the area of the converter opening during the deoxidizing phase in the converter and/or to add during the pouring from the converter a deoxidizing agent to avoid steel oxidation and keep the converter atmosphere free of oxygen.

The equipment to carry out the above described process is advantageously characterized in that there is a converter to decarburize and deoxidize the steel in several phases, the converter permitting successive treatments with an inert gas/air/oxygen mixture and pure inert gas with gas amounts differing greatly from each other.

It is advantageous for the converter to have a device which permits a temporary area reduction of the converter opening.

Advantageously, the converter may further have gas injection holes and a gas volume control, both permitting infinite variation of the different gases to be injected. Individual control of the gas injection hole admissions may be advantageous.

The invention permits the production of a particularly highgrade steel at little equipmental expense; and, while avoiding the use of vacuum during the adjustment of the steel to the desired metallurgical values, yet making possible a stable and qualitatively reproducible control.

As compared to presently known equipments and processes, the invention is characterized by;

- a simple possiblity of exact regulation of the chemical analysis and temperature of the steels,
- simple regulation of the final values depending on requirements,
- better mechanical values in the final production,
- a yield improvement,
- reliable reproducibility of the results through simple controllability,
- energy-saving operating mode friendly to the environment,
- economical utilization of the raw materials,
- low investment costs at corresponding quality targeting.

Accordingly, it is an object of the invention to provide a method for producing steels of high quality and low gas content in steel mills and steel foundries which comprise melting the steel with the desired alloying components in a ladle, directing an inert gas and oxygen mixture into the ladle with the molten steel to decarburize the steel in at least one phase of operation, and carrying out various decarburization, deoxidation and fining in separate operational steps without disturbing the coherence of the entire process cycle.

A further object of the invention is to provide an improved apparatus for carrying out the method of the invention which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
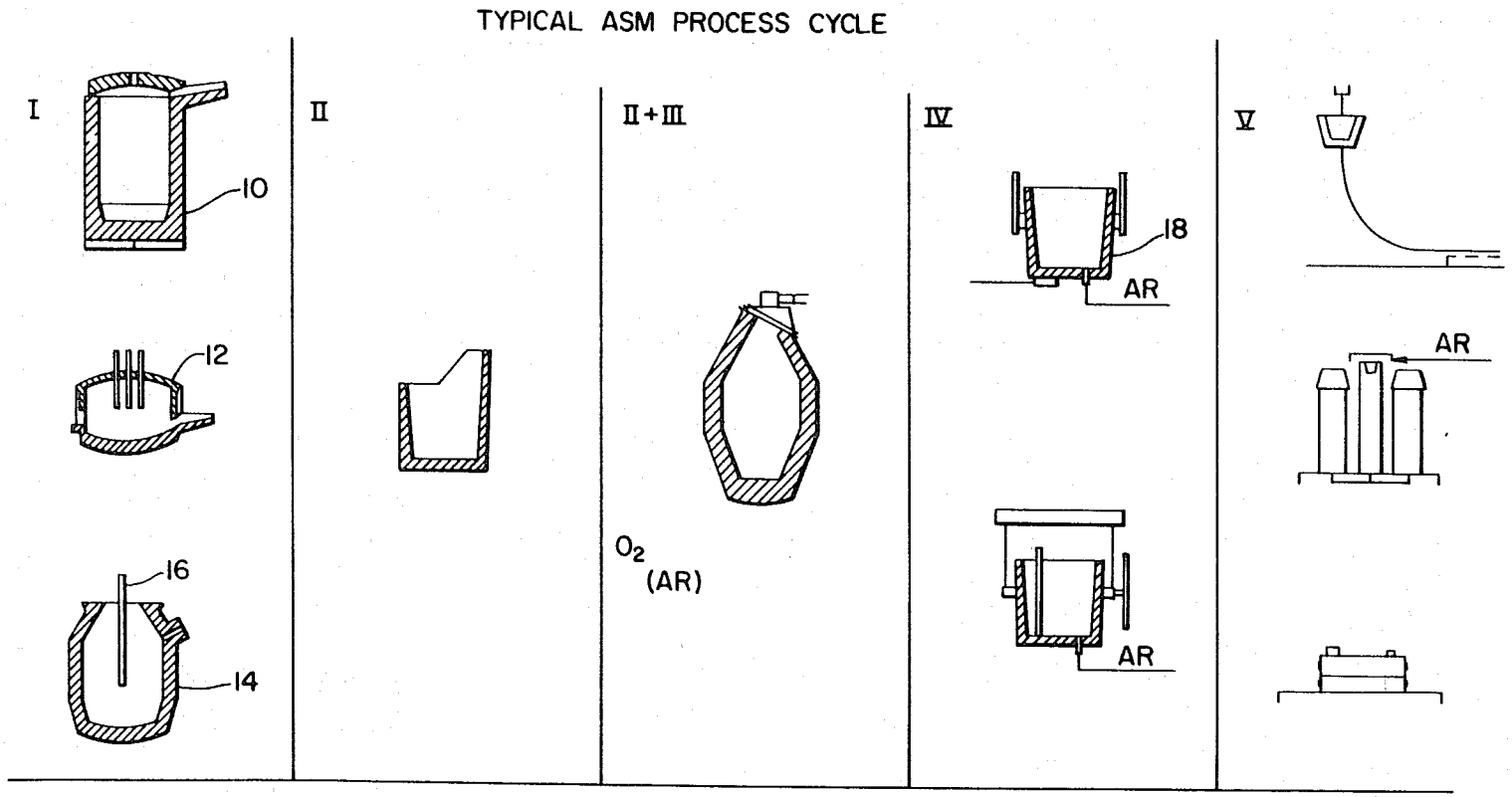
FIG. 1 is a schematic showing of the various phases or stages I to V of steel production according to the invention.
Figure 2:
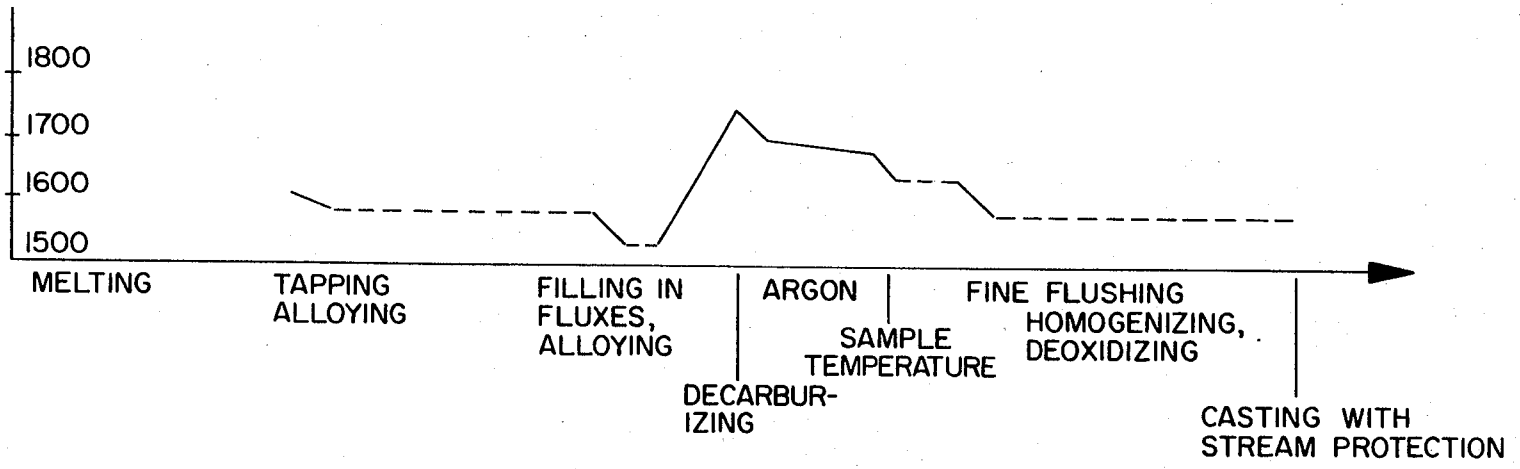
FIG. 2 is a curve indicating the temperature control during the various phases per FIG. 1.

Referring to the drawings, in particular the invention embodied therein comprises a method for producing steels of high purity and low gas content in steel mills and steel foundries which comprises melting the steel with the desired alloying components in a ladle, directing an inert gas and oxygen mixture into the ladle with the molten steel to decarburize the steel in at least one stage, and carrying out various decarburization, oxidation and fining in separate operational steps without disturbing the coherence of the entire process cycle. Molten steel is flush with an inert gas inner ladle. Decarburization is effected by means of the inert gas and air and oxygen mixture in a converter in one or more stages before the ladle treatment and after the desired alloying components are melted in. The various treatment stages of decarburization, deoxidation and fining are separated so that each step can be carried out optimally without disturbing the coherence of the total process cycle. Advantageously, a collecting slag containing deoxidizing substances is added to the melt in the ladle. The melt is fined flushed in the ladle treatment time. The decarburization in the converter is followed by a deoxidizing stage with simultaneous intensive flushing with inert gas.

The converter is advantageously emptied over its rim and the slag is poured into the ladle along with the rest. The oxygen content of the steel is adjusted to less than 20 parts per million for steels containing chromium and less than 10 parts per million for unalloyed or medium alloyed steels. The inert gas atmosphere is maintained while the converter is being tapped.

The thruput of inert gas or air or air and oxygen or inert gas and oxygen during the heating and deoxidizing stages is a multiple of at least 10 to 20 times of the inert gas thruput in the ladle during the fine flushing stage.

According to FIG. 1, the steel is melted stage or phase I, either in a cupola 10, induction or arc furnace 12, or in a crucible 14 heated by a lance 16.

In phase II the steel is tapped, and the desired alloying additives and other additives are added to make the required temperature increase during the reduction process according to phases II and III possible.

In phases II and III, after filling in the fluxes and additives, the converter treatment with oxygen, nitrogen, air or argon or mixtures of these gases takes place.

After pouring the melt into a ladle 18 according to phase IV, a fine flushing operation is carried out there, whereupon either ingot, mold, or extrusion casing, etc. takes place in phase V.

In detail, after tapping a smelting unit per phase I, the alloying and flux elements are added, followed by the mentioned two-phase treatment in a converter. Due to the injection of the known inert gas/air/oxygen mixture a rapid and intensive decarburization with a substantial temperature rise from about 1500° to over 1700° C. takes place. This operation can be assisted by a lance. Then follows a quick deoxidizing phase with a relatively small temperature drop, in which the desired adjustment to the final analysis already takes place to the greatest possible extent, and in which the oxides generated during the decarburization phase are largely reduced. Pouring takes place after the rapid deoxidation phase with high gas throughputs. This is followed by a fine flushing phase in the ladle with considerably lesser gas throughputs such as 0.1 to 0.5 $m^3/t$.

In this connection, it is necessary that the mixing and control units for the introduction of the needed gases into the converter be of appropriate design and the injection openings in or near the bottom of the converter be designed so that they stay free of penetrating steel also in phases with little gas throughput.

During the deoxidizing phase it is advantageous to reduce the area of the converter opening. The mechanism to reduce the converter opening area may be designed so that it can stay on the converter when the melt is tapped.

As the process progresses, the melt is emptied over the converter rim, in which operation the slag is also poured into the ladle, forming there a part of the collecting slag. The inert gas atmosphere in the converter is maintained during the tilting operation, and the steel flowing out is skirted, using a deoxidizing agent or an inert gas screen, to prevent reoxidation with air oxygen.

With this ladle aftertreatment, the desired metallurgical values as to chemical analysis, temperature, and degree of purity are adjustable precisely, the melt becoming so that later, coarser inclusions can be avoided. Steels having better mechanical properties originate.

In phase V, the steel is then cast under pouring stream protection.

When carrying out the method it must be seen to it that all alloys used are dry and all additives are added to the melt so early that they are also well flushed through.

All slag formers should be filled into the converter in advance, and the charge should be refilled slagfree. In the converter, at least 0.5% carbon is removed by decarburization.

The supply of process gas must be controllable in the range from 0.5 to 2.0 $Nm^3t/min$ with a suction system designed to handle the developing quantities of flue gas.

While the charge is being treated in the converter, it should be flushed with at least 4 to 6 $Nm^2$ Ar/t, and the time until tapping after completion of the melt must not exceed 5 to 10 min.

It is advantageous, furthermore, to use a basic or neutralined ladle. It should be preheated well and equipped with one or more bottom flushing bricks. The ladle is lined with refractory material which does not give up oxygen, e.g. dolomite.

The special advantages of the method and equipment according to the invention are, among others, that they can be used for the production of better steel not only is industrial countries, but, on account of their simplicity and stability, successfully also in not highly industrialized countries.

Advantageously a deoxidizing agent is added to the steel flowing out during the tapping operation. The steel flowing out is protected against reoxidation by a veil of inert gas. The slag is adjusted to the following composition at the end of the total treatment per 10 parts as follows:

1–2×$Al_2O_3$;
1–3×$Si^0{}_2$;
2–5×CaO;
1–2×MgO; and
1× other metal oxides.

The carbon content of this steel is advantageously reduced by at least 0.5% during the decarburization period. The decarburization period is shortened by additional blasting or injection of oxygen by means of a lance. Oxide containing solids are added by means of a carried gas through a lance.

The reaction space in the converter is advantageously between 0.45 to 0.80 $m^3$ per ton output.

While specific embodiments of the invention have been shown and described in detail to illustrate the application of the principles of the invention, it will be understood that the invention may be embodied otherwise without departing from such principles.

I claim:

1. A method for producing steels of high purity and low gas content in steel mills and steel foundries, comprising:

melting the steel to form molten steel;
tapping the molten steel into a converter;
adding alloying additives to the molten steel;
decarburizing the molten steel plus alloying additives by directing an inert gas, air and oxygen mixture into the convertor in at least one stage;
deoxidizing the molten steel plus alloying additives by intensely flushing the molten steel plus alloying additives with an inert gas, said deoxidizing taking place during said at least one stage and resulting in the formation of slag containing deoxidizing substances;
tapping the molten steel with alloying additives and slag into a ladle that is lined with a refractory material; and
fine flushing the molten steel plus alloying additives and slag in the ladle.

2. A method according to claim 1, wherein the converter is emptied over its rim and wherein the slag is poured into the ladle along with the molten steel and additives.

3. A method according to claim 1, wherein the oxygen content of the steel is adjusted to less than 20 parts per million for steels containing chromium and less than 10 parts per million for unalloyed or medium alloyed steels.

4. A method according to claim 1, including maintaining an inert gas atmosphere while the converter is tapped.

5. A method according to claim 1, including fine flushing the molten steel plus additives and slag in the ladle using an amount of inert gas, an amount of the mixture of inert gas, air and oxygen used during decarburizing as well as said intense inert gas flow used for decarburizing, being at least 10 to 20 times as large as the amount of inert gas used for fine flushing.

6. A method according to claim 1, wherein the convertor includes an opening having an area, the area being reduced during the deoxidizing step.

7. A method according to claim 1, including lining the ladle before it receives the molten steel plus additives and slag from the convertor, with refractory material which does not give up oxygen.

8. A method according to claim 7, including lining the ladle with dolomite.

9. A method according to claim 5, wherein the convertor includes an opening having an area, the area being reduced during the deoxidizing step.

10. A method according to claim 9, wherein a slag is formed after the operation which is adjusted to the following composition in respect to each 10 parts:

1–2×$Al_2O_3$
1–3×$SiO_2$
2–5×$C_aO$
1–2×$M_gO$
1× other metal oxides.

11. A method according to claim 10, wherein the carbon content of the steel is reduced by at least 0.5% during the decarburizing step.

12. A method according to claim 11, wherein the decarburization period is shortened by additional blowing of oxygen to the molten steel by means of a lance.

13. A method according to claim 12, including lining the ladle before it receives the molten steel plus additives and slag from the convertor, with refractory material which does not give up oxygen.

14. A method according to claim 1, wherein a deoxidizing agent is added to the steel flowing out during the tapping operation from the convertor.

15. A method according to claim 6, wherein the steel flowing out of the convertor is protected against reoxidation by a veil of inert gas.

16. A method according to claim 1, wherein a slag is formed after the operation which is adjusted to the following composition in respect to each 10 parts:

1–2×$Al_2O_3$
1–3×$SiO_2$
2–5×$C_aO$
1–2×$M_gO$
1× other metal oxides.

17. A method according to claim 1, wherein the carbon content of the steel is reduced by at least 0.5% during the decarburizing step.

18. A method according to claim 17, wherein the decarburization period is shortened by additional blowing of oxygen to the molten steel by means of a lance.

19. A method according to claim 17, wherein the oxide containing solids are added by means of a carrier gas through a lance.

20. A method according to claim 1, wherein a specific reaction space in the converter is from 0.45 to 0.80 $m^3$ per ton output.

* * * * *